US010741917B2

(12) United States Patent
Pelletti

(10) Patent No.: US 10,741,917 B2
(45) Date of Patent: Aug. 11, 2020

(54) POWER DIVISION IN ANTENNA SYSTEMS FOR MILLIMETER WAVE APPLICATIONS

(71) Applicant: Metawave Corporation, Palo Alto, CA (US)

(72) Inventor: Chiara Pelletti, Palo Alto, CA (US)

(73) Assignee: Chiara Pelletti, San Francisco, CA (US)

( * ) Notice: Subject to any disclaimer, the term of this patent is extended or adjusted under 35 U.S.C. 154(b) by 92 days.

(21) Appl. No.: 16/183,689

(22) Filed: Nov. 7, 2018

(65) Prior Publication Data

US 2019/0140351 A1 May 9, 2019

Related U.S. Application Data

(60) Provisional application No. 62/582,879, filed on Nov. 7, 2017.

(51) Int. Cl.

| | |
|---|---|
| ***H01Q 5/371*** | (2015.01) |
| ***H01Q 3/26*** | (2006.01) |
| ***H01Q 1/38*** | (2006.01) |
| ***H01Q 1/50*** | (2006.01) |
| ***H01Q 25/00*** | (2006.01) |
| ***H01Q 21/00*** | (2006.01) |
| ***H01Q 15/00*** | (2006.01) |

(52) U.S. Cl.

CPC ..... *H01Q 5/371* (2015.01); *H01Q 1/38* (2013.01); *H01Q 1/50* (2013.01); *H01Q 3/2605* (2013.01); *H01Q 15/0086* (2013.01); *H01Q 21/005* (2013.01); *H01Q 21/0075* (2013.01); *H01Q 25/005* (2013.01)

(58) Field of Classification Search

CPC ..... H01Q 5/371; H01Q 1/38; H01Q 1/50; H01Q 3/26; H01Q 15/00; H01Q 21/00; H01Q 25/00

USPC ..... 343/702

See application file for complete search history.

(56) References Cited

U.S. PATENT DOCUMENTS

| | | | | |
|---|---|---|---|---|
| 6,650,290 | B1 * | 11/2003 | Chang | H01Q 3/26 342/368 |
| 7,250,908 | B2 | 7/2007 | Lee | |
| 7,847,739 | B2 * | 12/2010 | Achour | H01Q 1/38 343/700 MS |
| 8,633,866 | B2 | 1/2014 | Sarabandi et al. | |
| 9,545,923 | B2 | 1/2017 | Casse et al. | |

(Continued)

OTHER PUBLICATIONS

M. Danaeian, et al., "Miniaturised equal/unequal SIW power divider with bandpass response loaded by CSRRs," Electronics Letters, vol. 52, No. 22, Oct. 2016, pp. 1864-1866.

(Continued)

*Primary Examiner* — Andrea Lindgren Baltzell

(74) *Attorney, Agent, or Firm* — Sandra Lynn Godsey

(57) ABSTRACT

Examples disclosed herein relate to a power division structure. The power division structure has an input port to receive a transmission signal, a plurality of output ports to transmit portions of the transmission signal to a signal structure, and a plurality of transmission paths to propagate the transmission signal from the input port to the plurality of output ports, each transmission path having an associated weight and configured with power division vias to distribute the transmission signal according to its associated weight.

20 Claims, 8 Drawing Sheets

(56) References Cited

U.S. PATENT DOCUMENTS

2016/0013531 A1* 1/2016 Casse ..... H01P 1/184
333/161

OTHER PUBLICATIONS

T. Li, et al., "Broadband substrate-integrated waveguide T-junction with arbitrary power-dividing ratio," Electronics Letters, vol. 51, No. 3, Feb. 2015, pp. 259-260.

A. Lai, et al., "Leaky-Wave Steering in a Two-Dimensional Metamaterial Structure Using Wave Interaction Excitation," IEEE MTT-S International Microwave Symposium Digest, San Francisco, CA, Jun. 2006.

* cited by examiner

POWER DIVISION IN ANTENNA SYSTEMS FOR MILLIMETER WAVE APPLICATIONS

CROSS-REFERENCE TO RELATED APPLICATIONS

This application claims priority to U.S. Provisional Application No. 62/582,879, filed on Nov. 7, 2017, and incorporated herein by reference.

BACKGROUND

Many transmission signals use a variety of feed or power division structures to provide a signal to one or more transmission lines. These structures each have advantages and disadvantages as they seek to balance the power division, phase control and impedance matching functions. Depending on the application, a given power division structure may be highly effective at one of these parameters but at the expense of another parameter, characteristic of behavior.

Recently, millimeter wave applications have emerged that impose ambitious goals on system design, including the ability to generate desired beam forms at a controlled direction while avoiding interference among the many signals and structures of the surrounding environment. The millimeter wave spectrum provides narrow wavelengths in the range of ~1 to 10 millimeters that are susceptible to high atmospheric attenuation and have to operate at short ranges (just over a kilometer). Millimeter wave applications such as 5G and autonomous vehicles depend on advanced sensing and detection under challenging conditions. Current solutions do not meet the power division capabilities required.

BRIEF DESCRIPTION OF THE DRAWINGS

The present application may be more fully appreciated in connection with the following detailed description taken in conjunction with the accompanying drawings, which are not drawn to scale and in which like reference characters refer to like parts throughout and wherein.

DETAILED DESCRIPTION

Power division in antenna systems for millimeter wave applications is disclosed. The power division is suitable for many different millimeter wave ("mm-wave") applications and can be deployed in a variety of different environments and configurations. Mm-wave applications are those operating with frequencies between 30 and 300 GHz or a portion thereof, including autonomous driving applications in the 77 GHz range and 5G applications in the 60 GHz range, among others. In various examples, power division structures and methods divide an input signal into unequal or equal power levels across multiple transmission lines.

It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

Figure 1:
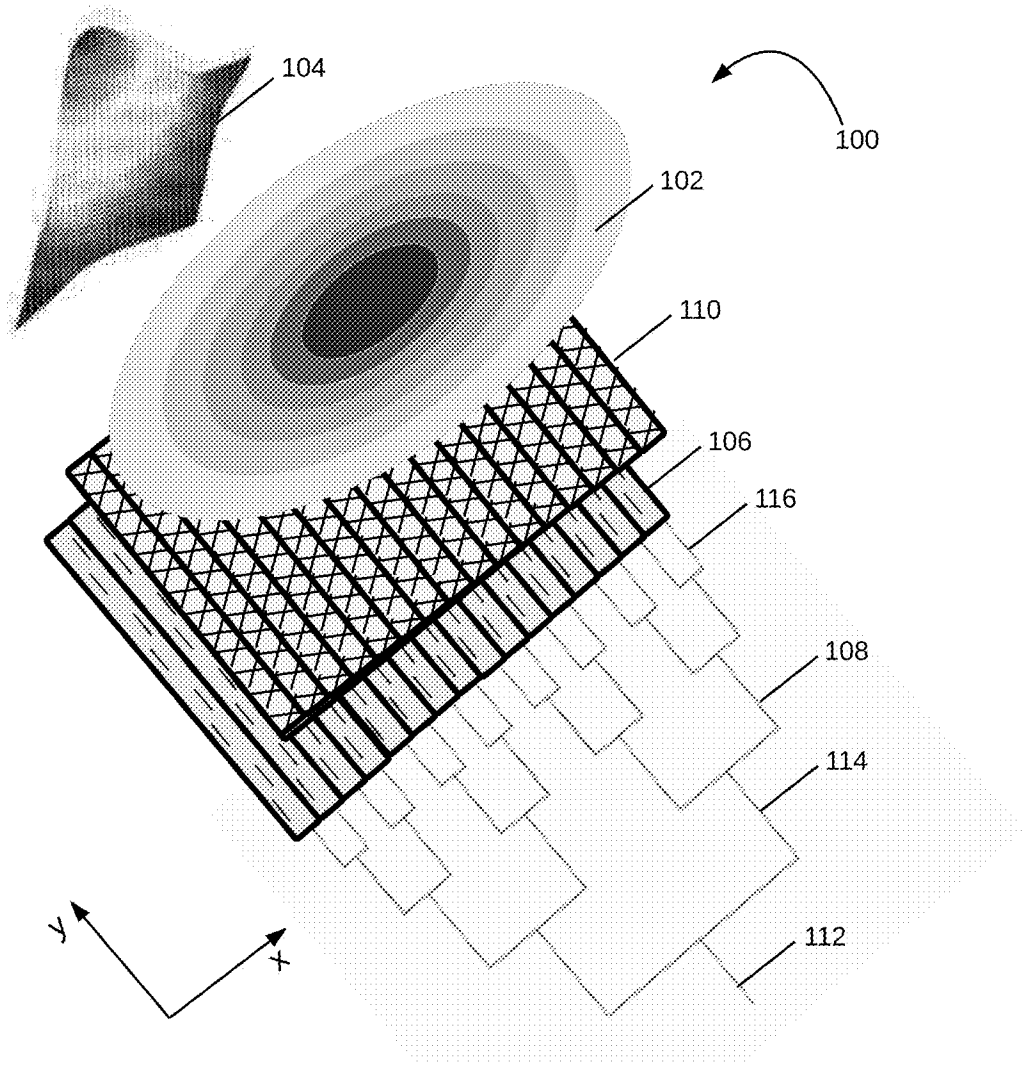
FIG. 1 is a schematic diagram illustrating an antenna system in accordance with various examples.

FIG. 1 illustrates an antenna system 100 having a target field aperture distribution 102 occurring on the antenna aperture plane, that in the far-field will convert to far-field pattern 104. Pattern 104 is radiated from antenna 106, which may be a Substrate Integrated Waveguide ("SIW") antenna array in various examples. SIW antennas are particularly suitable for high gain applications because their radiating elements exhibit good radiation performance. In millimeter wave applications such as radars in autonomous vehicles, the antenna is one of the critical components affecting the performance of the entire system. It is desirable to increase the range of detection and resolution of the antennas in these applications to ensure optimal detection of targets in and around the path of the vehicles. Antenna 106 is therefore designed to achieve a high gain and wide bandwidth performance, while having a compact size. Antenna 106 is also designed to guarantee low side lobe levels, which is a crucial feature to avoid false alarms in vehicle collision avoidance and intelligent cruise control that may lead to false or erroneous detection and tracking of targets in and around autonomous vehicles.

In various examples, a non-uniform aperture illumination function is required to realize an effective side lobe control in the design of antenna 106. As described in more detail herein below, this is achieved with the design of power division structure 108, which provides signals to antenna 106 and metastructure 110. Metastructure 110 is an engineered structure capable of controlling and manipulating the incident radiation from antenna 106 at a desired direction based on its geometry. The desired field aperture distribution 102 is high in a center position and tapers in the x and y directions to achieve very low side lobes. In this way, the energy is concentrated toward a target object, such as in an autonomous vehicle radar for detection or in wireless communications toward a user equipment ("UE").

As illustrated, the power division structure 108 has an input port 112 to receive a transmission signal, a plurality of transmission paths 114 to divide the transmission signal power as the signal propagates through the transmission paths, and a plurality of output ports 116 with power divided along the x-direction. Each transmission path 114 is connected to a channel in the antenna 106. In some examples, the power division is according to a Chebyshev weighting scheme; however, alternate examples may implement other distribution methods, schemes, configurations and so forth.

The power division structure 108 is illustrated as a tree structure having four (4) stages; each stage represents division of a single path into two paths. In this way, the four stages result in 16 output ports. This is one type of configuration, where the power division has symmetry in the x-direction. Alternate examples may incorporate a variety of structures or forms, depending on goals, construction, composition, space considerations, applications and so forth. Note that the tree structure described herein is provided for clarity of understanding. For example, a single path may divide into more than two paths, or the power division structure may be asymmetrical.

As described in more detail below, the weights are determined for each stage and each path to result in a desired power distribution across the output ports of the power division structure 108. In the present example, the power division structure 108 is used to provide a signal to antenna 106 and metastructure 110, to achieve a desired field aperture distribution 102.

Figure 2:
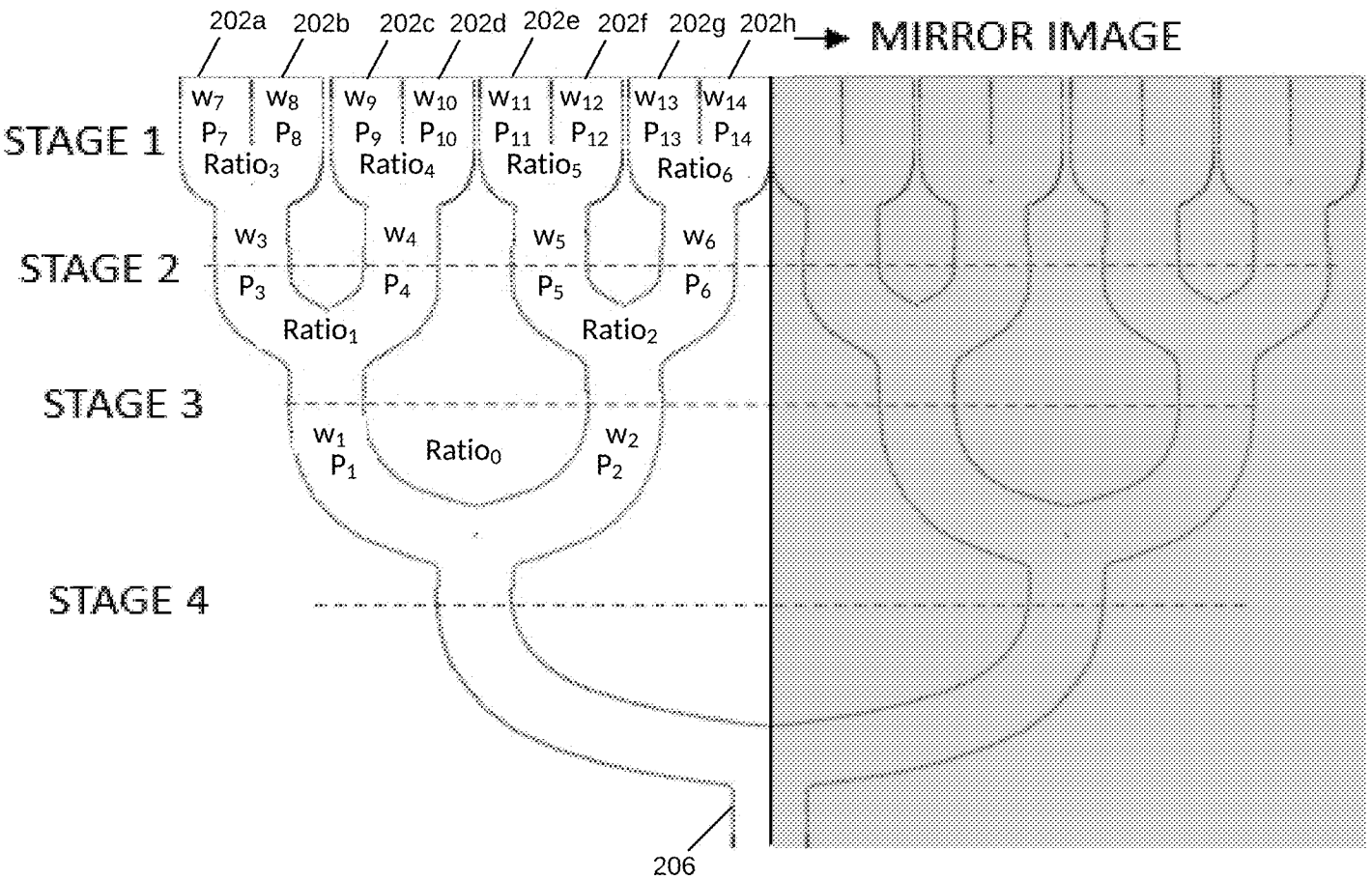
FIG. 2 is a schematic diagram of a power division structure with four stages and a symmetric configuration in accordance with various examples.

Attention is now directed to FIG. 2, which illustrates a power division structure 200 with four stages and a symmetric configuration. The illustration provides the connections and divisions within power division 200 but is not drawn to scale. The shape of the paths is drawn to provide clarity of configuration; however, specific builds may use different shapes and sizes to achieve the weights and divisions indicated.

As described herein, a target two-dimensional power distribution function is determined to achieve a specific low side lobe level far-field radiation pattern 104 shown in FIG. 1, such that in operation the power division structure 200 provides a given power level at each of the output ports 202. In various examples, the output power levels of the set of ports 202 may all be different and match a Chebyshev taper along the x-direction. Slot openings in the ground plane of a connected antenna structure (e.g., antenna 106 of FIG. 1) realize amplitude taper along the y-direction. This way, a two-dimensional Chebyshev amplitude distribution is realized over the aperture plane of the antenna 106, resulting in a desirable far-field pattern with low side lobes.

The power division structure 200 has several branches and divisions, wherein a single path is divided into two paths. Alternate examples may incorporate any number of paths and may use alternate division methods. As illustrated, the goal of the STAGE 1 output ports 202, configured in the x-direction, is to have high amplitude output power (energy) at the center with tapered amplitudes toward both ends. In this way, $P_1<P_4$, and $P_8<P_5$. The network of FIG. 2 illustrates multiple stages corresponding to multiple paths and power division levels. Each of the paths has an associated weight to achieve the final power division. For example, weight $w_9$ is applied to achieve a power level of $P_9$ in output port 202*c*.

Starting with STAGE 4, the input port 206 receives a transmission signal that is to propagate through the power division structure 200 to antenna 106 shown in FIG. 1. In alternate examples, the power division structure 200 may be coupled directly to an antenna structure, or other transmission elements. In STAGE 4, the power is divided equally into two paths. In STAGE 3, the power is divided according to $Ratio_0$ corresponding to weights $w_1$ and $w_2$. A similar division of power is performed on the other side of the power division structure 200 (denoted as the shaded mirror image). This process continues in STAGES 2 and 1, wherein each division has a given ratio and associated weights to determine the amount of power delivered along each path. Finally, the weights $w_7$ to $w_{14}$ are associated with the final power levels for each of the output ports 202. Alternate examples may implement other radiation schemes to achieve a specific outcome or amplitude distribution. Note that the weights $w_7$ to $w_{14}$ may result in unequal power levels at the output ports 202. In some examples, some or all of the weights may result in equal power levels at the output ports 202.

Figure 3:
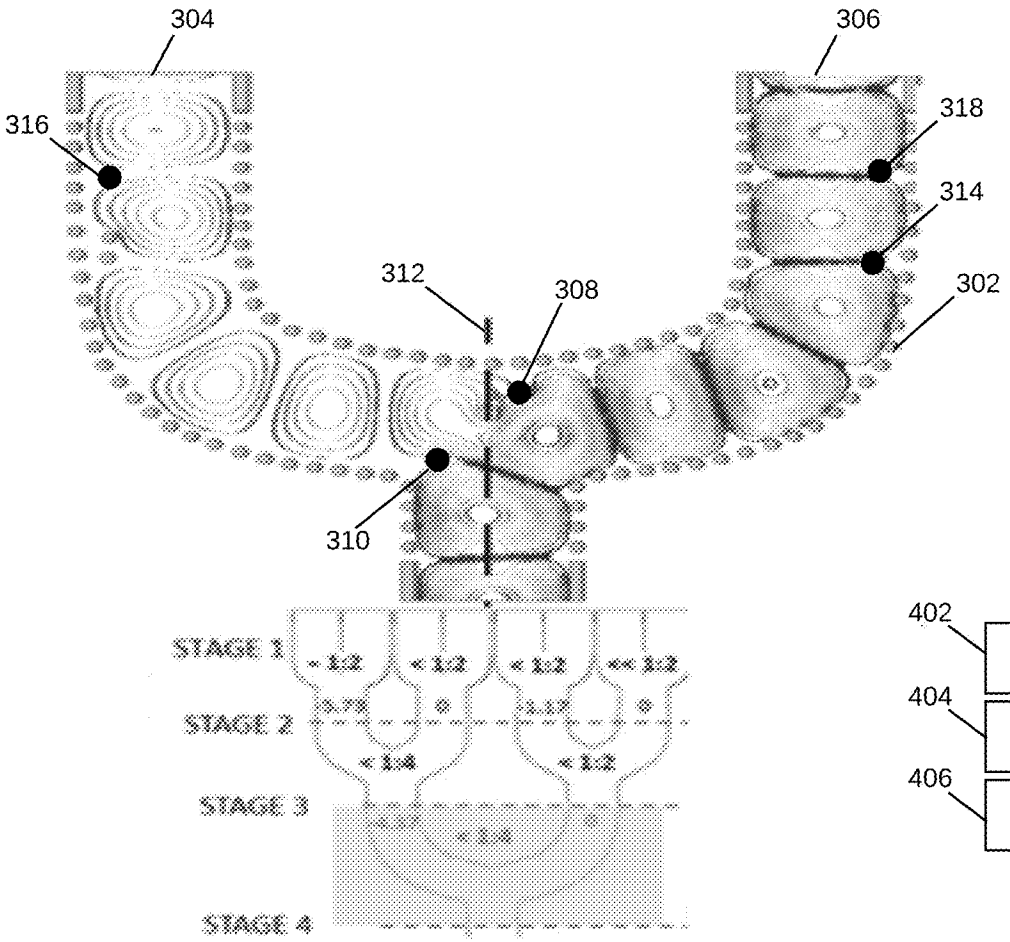
FIG. 3 is a schematic diagram illustrating a power division from one to two paths in accordance with various examples.

FIG. 3 illustrates a given power division from one path into two paths, wherein the paths are defined by vias 302 formed in a power division structure 300, having an output port 304 and an output port 306. The vias 302, shown in FIG. 3 as circles delineating the power division paths, are formed to create a conductive connection from a conductive layer 402, as in FIG. 4, through dielectric layer 404 to a reference conductive layer 406. The vias may be lined with conductive material to increase the conductivity between conductive layer 402 and conductive layer 406. The formation of the vias 302 is according to a path pattern of a power division structure 300.

As described above, it is desired to achieve an amplitude distribution in an antenna coupled to power division structure 300 that produces a radiation pattern with a high gain in a center position and low side lobe levels. The first consideration in achieving this is to weigh the power flow through each path of power division structure 300. To achieve the weighted power division, weights are assigned to each path, and power division vias are added to limit the power to one or both paths. These power division vias, e.g., power division vias 308-310, are positioned asymmetrically with respect to a center line 312 through the power division structure 300. As illustrated, power division vias 308-310 are provided to reduce the power flow to port 304. The power division vias 308-310 enable more power flow to output port 306 As illustrated, the power flowing through the path to output port 306 is greater than that in the path to output port 304.

The power division vias 308-310 are used to apply the weights to each path, but may also alter the phase of the transmission propagating through the path to output port 304. To match the phase in the two paths while keeping their length the same, the power division structure 300 includes phase correction via 314. Phase correction vias are provided part way up the path to output port 306. In this example, a single phase correction via 314 operates to adjust the phase in the path to output port 304. In other examples, additional phase correction vias may be added as needed.

Another consideration in designing the power division structure 300 to achieve the desired amplitude distribution is the input impedance matching at each division point of the power division structure 300. To match the input impedance, power division structure 300 includes stabilization vias 316-318, which are symmetric with respect to the centerline.

Note that FIG. 3 also provides a visual model of transmission signals propagating through power division structure 300, wherein the strength of the signal in the path to output port 306 is stronger than that going through the path to output port 304. The output ports 304-306 are part of STAGE 2 of power division structure 300.

Figure 4:
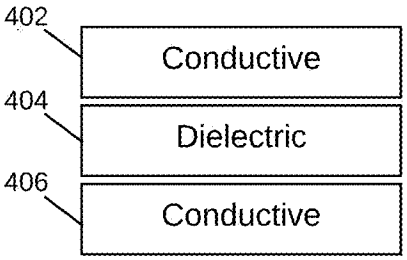
FIG. 4 is a schematic diagram of a layered structure in which a power division structure is built in accordance with various examples.

FIG. 4 illustrates a layered structure 400 in which a power division structure is built. The layered structure is a substrate that includes various components, and may include a power division structure and an antenna feed structure, as described herein. The layers include a top conductive layer 402, a dielectric layer 404 and a reference conductive layer 406. The layers form a composite structure in which transmission paths may be constructed. Alternate examples may include any number of layers and configurations. The vias described herein are from one conductive layer to another conductive layer. The via structures 302 of FIG. 3 form a pattern that contains a propagated electromagnetic wave through the power division structure 300. The placement, design, size and spacing of the via structures 302 are specific to the application, design parameters and frequency of the transmission signals that will go through the power division structure 300.

In various examples, the power division structures described herein are structured to provide unequal power to multiple output ports which may be coupled to an antenna structure(s) to realize amplitude taper in at least one direction. As described herein, the power division is a function of a wireless systems, wherein the power division structures feed an antenna; however, the power division methods and apparatuses may be incorporated into alternate designs and applications.

Figure 5:
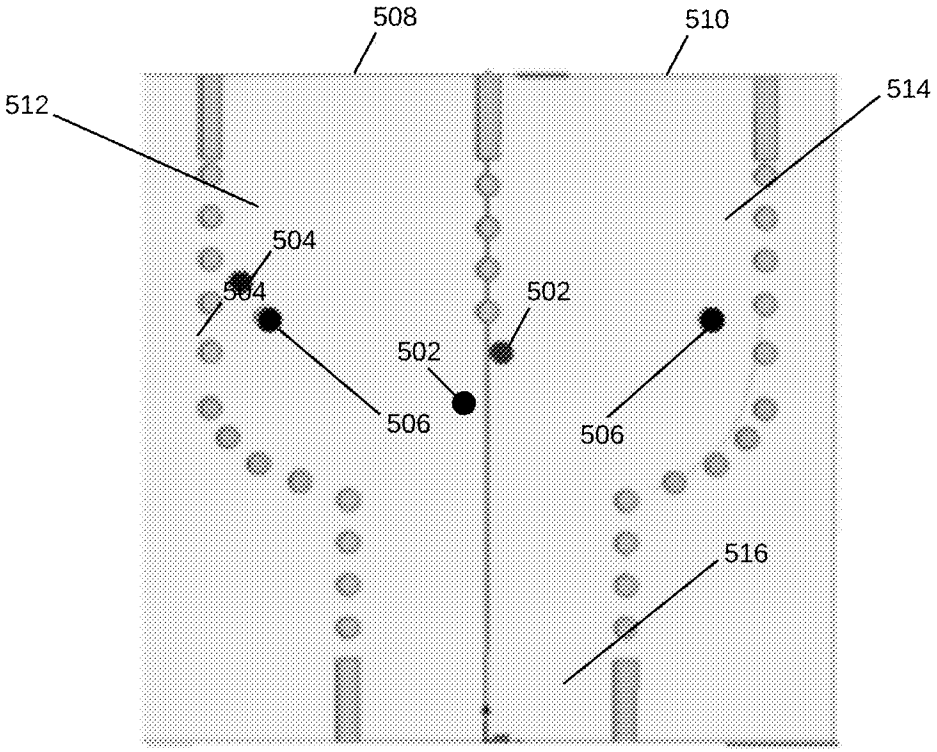
FIG. 5 illustrates a portion of a power division structure having a plurality of vias defining its paths according to various examples.

Attention is now directed to FIG. 5, which illustrates a portion of a power division structure having a plurality of vias defining its paths according to various examples. The power division vias 502 is provided to adjust the power of each path according to a given ratio, wherein each path has a corresponding weight. The phase correction via 504 is provided to keep the phase approximately the same in both paths without altering their lengths. Alternate examples may use a phase correction via to provide a specific relationship between the phases of each path. In the examples described herein, the goal is for the transmission signal at each output port of the power division structure 500 to be in phase with each other.

In the examples illustrated in FIG. 5, a set of stabilizer vias 506 are provided for impedance matching at the input port 516. The stabilizer vias 506 are positioned such that each path in the power distribution structure 500 has an impedance that is approximately equal to the impedance of its input. In this way, the impedance of paths 512-514 will have approximately the same impedance as path 516. Without the stabilizer vias 506, there may be a mismatch between one or more of paths in power division structure 500. It is appreciated that impedance matching improves power transfer and reduces signal reflection at each division point. This is a consideration for efficient and reliable signal propagation in power division structure 500.

Figure 6:
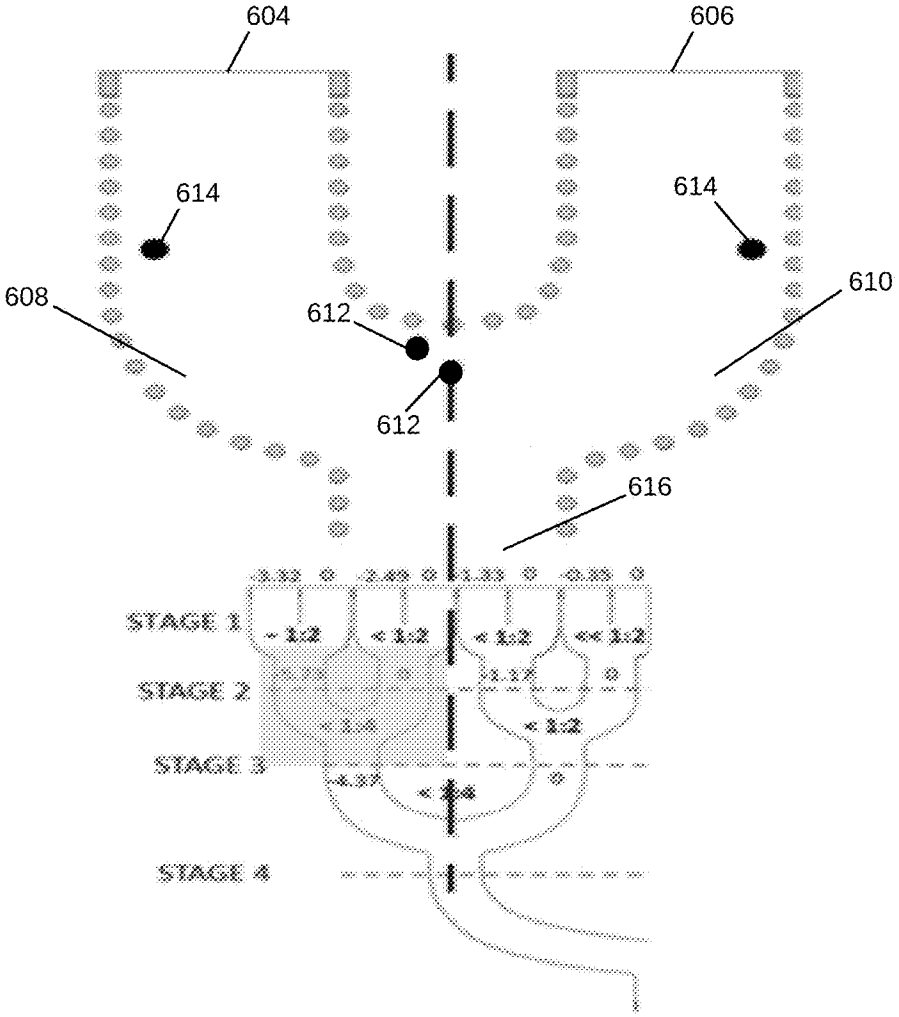
FIG. 6 illustrates another example power division structure.

FIG. 6 illustrates another example of a power division structure 600 having a portion 602. The power division structure portion 602 has output ports 604 and 606. Power division structure portion 602 creates a weighted power division between the two paths 608-610. In this configuration, the power division vias 612 are positioned in a way that the phase is approximately the same in both paths, and therefore no phase correction vias are included. The stabilizer vias 614 are provided for impedance matching at input port 616.

Figure 7:
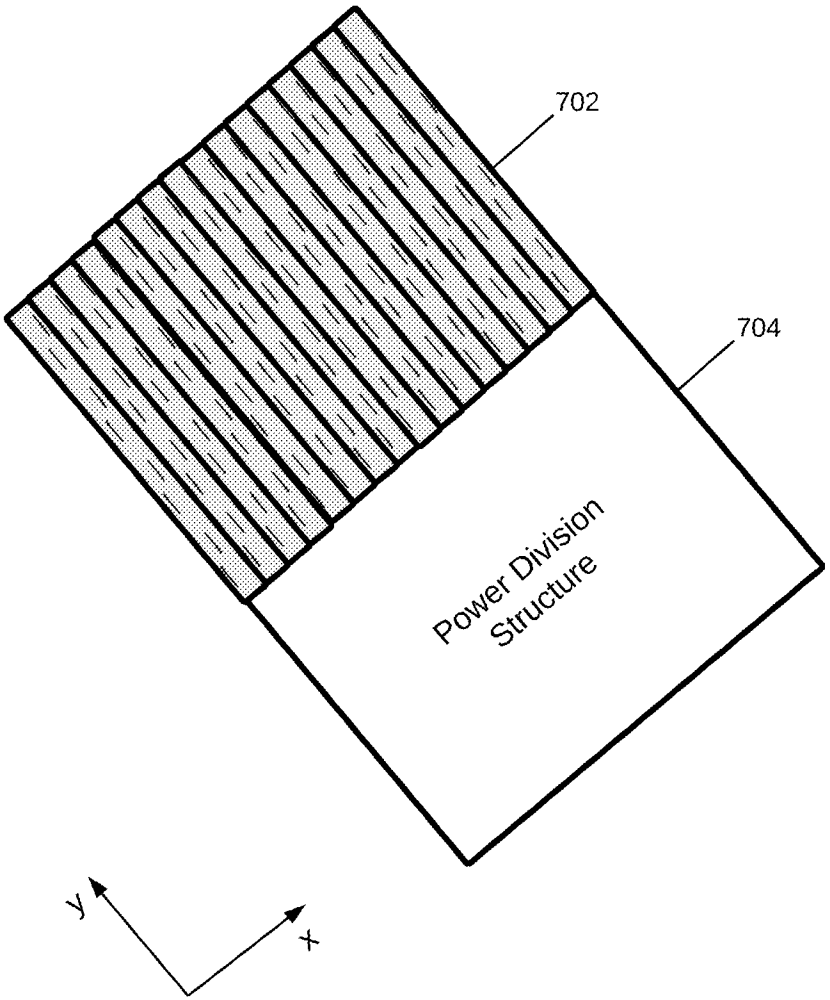
FIG. 7 illustrates an antenna system in accordance with various examples.
Figure 8:
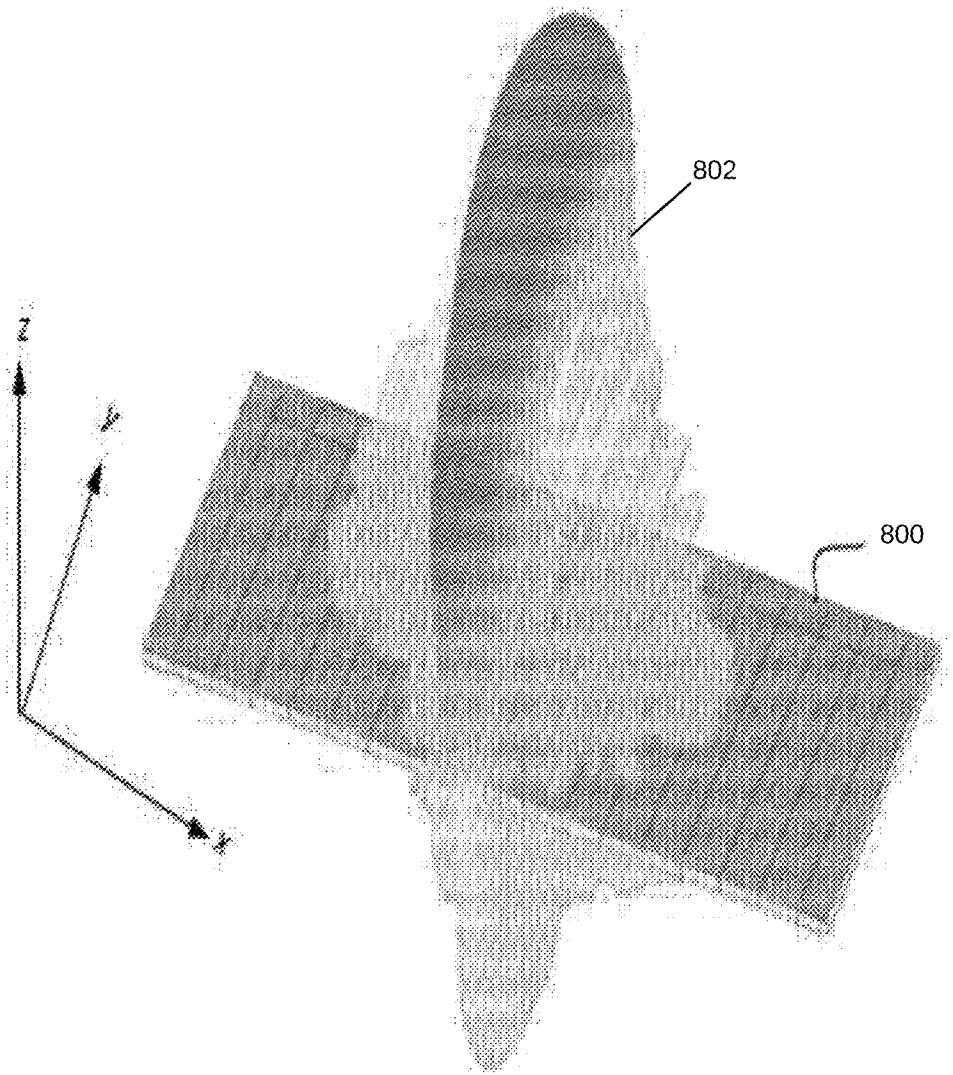
FIG. 8 illustrates an antenna for use with a power division structure in accordance with various examples.

FIG. 7 illustrates an example of an antenna system 700, having an antenna structure 702 that is coupled to power division structure 704. A transmission signal received at the power division structure 704 is propagated to an antenna structure 406. The signal is then radiated from the antenna structure 406. In this example, the power division structure 704 is configured as in FIG. 1, such that each of the transmission lines of antenna structure 702 receives a unique power level of the transmission signal. In FIG. 8, an antenna 800 is shown, which is part of an antenna system having a power division structure as described above. The resultant beam form 802 is generated from antenna 800 into the z-direction, and has low side lobes on the x-z plane. To reduce side lobes in the y-z plane, the antenna slot positions may be configured in a non-symmetrical way with respect to the waveguide centerline.

Figure 9:
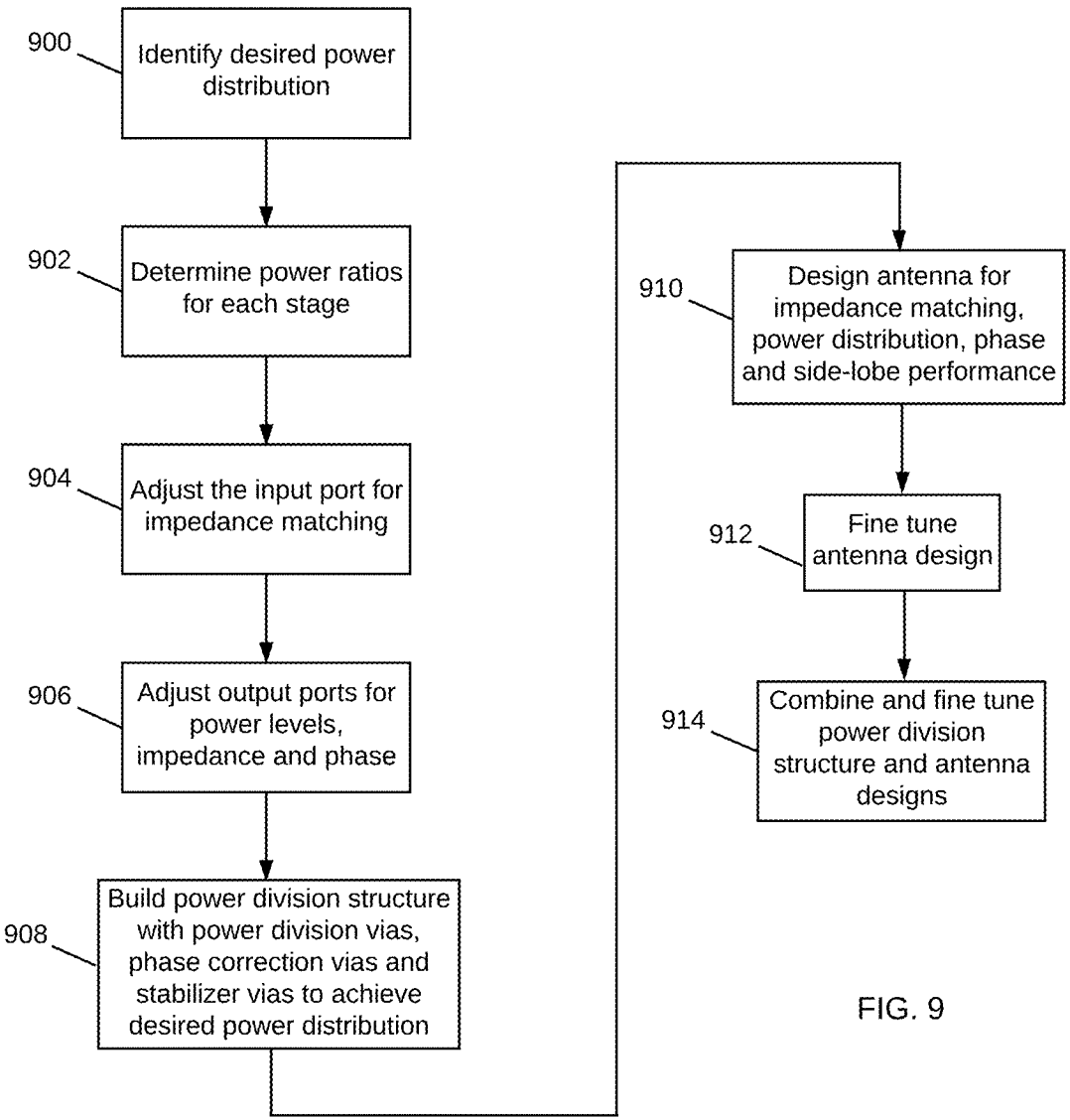
FIG. 9 is a flowchart for designing a power division structure and an antenna to achieve a high gain and wide bandwidth performance, while having a compact size and low side lobes in accordance with various examples.

Attention is now directed to FIG. 9, which illustrates a flowchart for designing a power division structure and an antenna to achieve a high gain and wide bandwidth performance, while having a compact size and low side lobes. The first steps in designing such a structure are to identify the desired power distribution (900) and determine the power ratios that each stage in the power division structure needs to realize individually (902). For example, in a 4-stage power division structure such as that shown in FIG. 2, STAGE 4 does not have to realize a power ratio at its output ports, it just needs to be optimized for good matching at the input port. In STAGE 1, there are four power ratios to be determined. Once each stage has its power ratios, the next step is to adjust the input port for any potential mismatch (904). The design is also adjusted for potential mismatch of power levels and phase discrepancies at the output ports (906). The power division structure is then built with power division vias, phase correction vias and stabilizer vias as needed to achieve the desired power distribution, phase and impedance matching (908).

As the power division structure is designed to operate with an antenna, each antenna channel is also optimized in periodic boundary conditions for good matching and proper power distribution out of the antenna slots (910). The full antenna array is simulated and fine-tuned for good matching at each of its input ports, proper power distribution in its slots and desired phase and side-lobe performance (912). Once the antenna is optimized, it is combined with the power division structure for further fine tuning and optimal power distribution out of the antenna slots (914).

The present application provide methods and apparatuses for generating wireless signals, such as radar signals, having improved directivity, reduced undesired radiation patterns aspects, such as side lobes. The present application also provides devices with the capability of efficiently dividing the power of a received transmission signal into multiple paths, while maintaining a desired phase relationship of the multiple paths and matching impedance throughout the devices. When coupled to a target signal structure, such as an antenna structure, the reflected signal is reduced or eliminated. These inventions are particularly applicable for directed beam generation in a wireless transmission device. This directivity may be used to improve the capability of sensors, such as to support object detection for autonomous driving. As described in this disclosure, examples include power division structures that are designed to divide a signal among a plurality of transmission lines, wherein the power may be distributed unequally among multiple transmission lines. The power division structure may be designed to specify unique signal strength to each of the transmission lines.

Some of the power division structures described herein include an impedance matching stabilizer structure formed by a set of vias positioned symmetrically with adjacent paths of a division point. Some of the power division structures described herein also include a phase correction structure formed by at least one via positioned asymmetrically within adjacent paths of a division point.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A power division structure, comprising:

an input port to receive a transmission signal;

a plurality of output ports to transmit portions of the transmission signal to a signal structure; and a plurality of transmission paths to propagate the transmission signal from the input port to the plurality of output ports, each transmission path having an associated weight and configured with power division vias to distribute the transmission signal according to its associated weight.

2. The power division structure of claim 1, wherein the portions of the transmission signal have unequal power.

3. The power division structure of claim 1, wherein a set of transmission paths in the plurality of transmission paths comprises a set of phase correction vias to maintain a phase of the transmission signal in the plurality of output ports.

4. The power division structure of claim 1, wherein a set of transmission paths in the plurality of transmission paths comprises a set of stabilizer vias to match an input impedance.

5. The power division structure of claim 1, wherein the associated weight in each transmission path is determined to satisfy a Chebyshev distribution.

6. The power division structure of claim 1, wherein the plurality of transmission paths is configured in a symmetric tree structure with multiple stages, wherein in each stage a transmission path is divided into two other transmission paths.

7. The power division structure of claim 1, comprising a layered structure formed of a top conductive layer, a dielectric layer and a reference conductive layer.

8. The power division structure of claim 7, where in the power division structure is formed by vias lined with a conductive material to create a conductive connection from the top conductive layer through the dielectric layer and to the reference conductive layer.

9. The power division structure of claim 1, wherein the signal structure comprises an antenna.

10. An antenna system, comprising:

a power division structure to divide a transmission signal received at an input port into unequal portions in a plurality of output ports through a plurality of transmission paths, each transmission path having an associated weight and configured with power division vias to distribute the transmission signal according to its associated weight;

an antenna having a plurality of channels, each channel connected to an output port to radiate the transmission signal into a radiation pattern; and a metastructure connected to the antenna to direct the radiation pattern into a controlled direction.

11. The antenna system of claim 10, wherein the antenna is an SIW antenna.

12. The antenna system of claim 11, wherein the SIW antenna comprises a plurality of non-symmetric slots to reduce side lobes.

13. The antenna system of claim 10, wherein a set of transmission paths in the plurality of transmission paths comprises a set of phase correction vias to maintain a phase of the transmission signal in the plurality of output ports.

14. The antenna system of claim 1, wherein a set of transmission paths in the plurality of transmission paths comprises a set of stabilizer vias to match an input impedance.

15. The antenna system of claim 10, wherein the associated weight in each transmission path is determined to satisfy a Chebyshev distribution.

16. A method for designing a power division structure coupled to an antenna, comprising:

identifying a desired power distribution for a plurality of output ports connected to an input port in the power division structure through a plurality of transmission paths;

determining power ratios for the plurality of transmission paths; and building the power division structure with a plurality of power division vias to achieve the desired power distribution, a plurality of phase correction vias to achieve a desired phase and a plurality of stabilizer vias to match input impedances in the plurality of transmission paths.

17. The method of claim 16, further comprising adjusting the input port for impedance matching.

18. The method of claim 16, further comprising adjusting the plurality of output ports for power levels, impedance and phase.

19. The method of claim 16, further comprising designing the antenna for impedance matching, power distribution, phase, and side-lobe performance.

20. The method of claim 16, further comprising placing the plurality of power division vias in the power division structure according to the determined power ratios.

* * * * *